US005615176A

United States Patent [19]

LaCarrubba

[11] Patent Number: 5,615,176

[45] Date of Patent: Mar. 25, 1997

[54] ACOUSTIC REFLECTOR

[76] Inventor: Emanuel LaCarrubba, 506 Olive St., Sausalito, Calif. 94966

[21] Appl. No.: 575,335

[22] Filed: Dec. 20, 1995

[51] Int. Cl.[6] ..... H04R 1/34

[52] U.S. Cl. ..... 367/151

[58] Field of Search ..... 367/151; 310/335; 128/663.01; 73/642; 181/175, 199; 381/156

[56] References Cited

U.S. PATENT DOCUMENTS 4,629,030 12/1986 Ferralli ..... 181/175

*Primary Examiner*—Daniel T. Pihulic

*Attorney, Agent, or Firm*—Phillips, Moore, Lempio & Finley

[57] ABSTRACT

An acoustic reflector is disclosed, which is formed from the surface generated by an ellipse rotated about 180° about a line passing through one of the focal points of the ellipse, where this line of rotation intersects the major axis at an acute angle. A transducer placed at the focal point on the line of revolution will, when energized, generate waves that will be reflected from the surface back through the arc of second focal points of the generating ellipse.

14 Claims, 4 Drawing Sheets

FIG._5
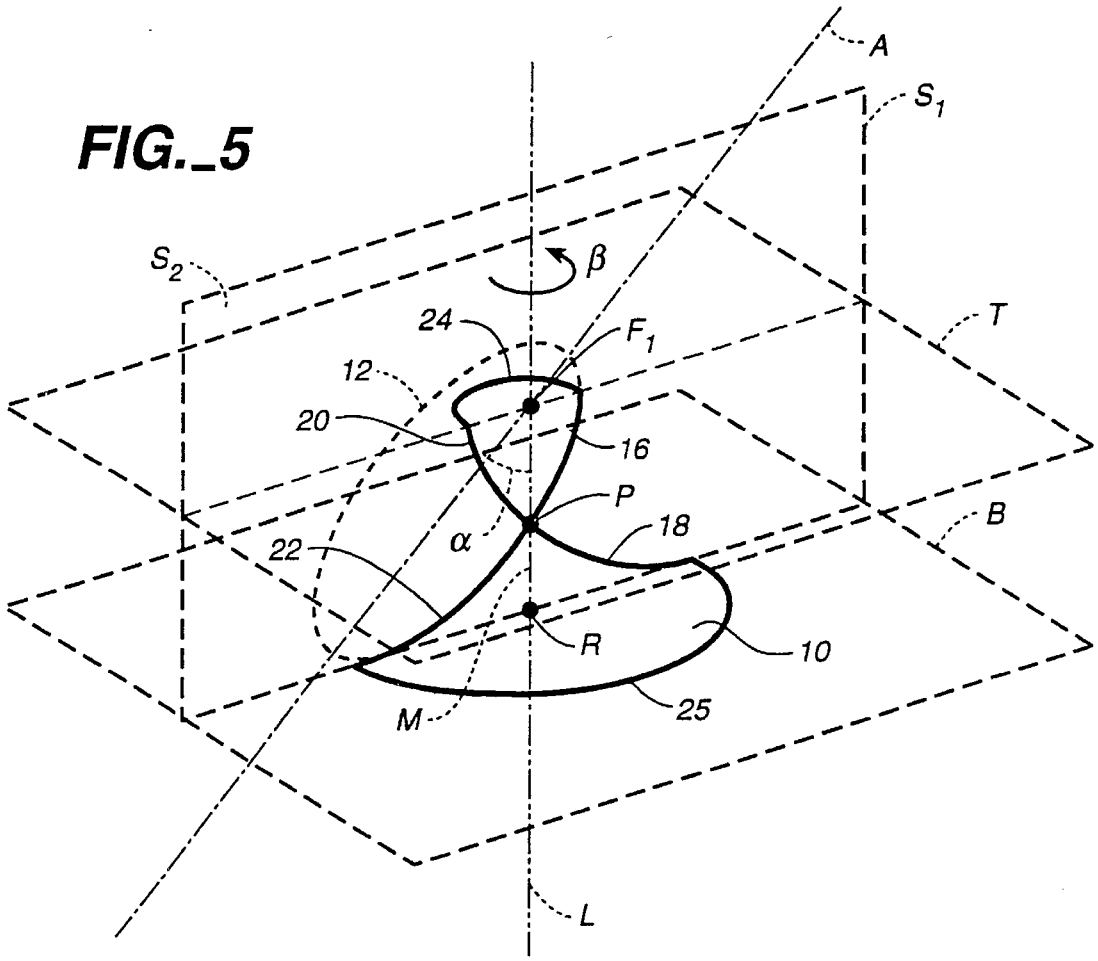
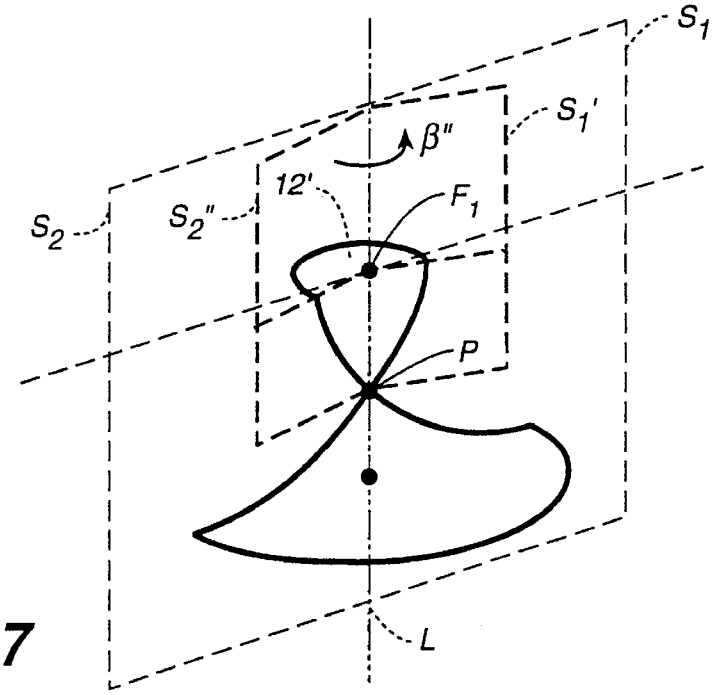
FIG._7

ACOUSTIC REFLECTOR

This invention relates to an acoustic reflector, specifically, a reflector that when coupled to a transducer is capable of a broad dispersion of sounds over a broad spectrum of frequencies with little or no distortion.

Acoustic transducers that radiate directly into air present several fundamental design problems. Most importantly, they do not radiate all frequencies equally in all directions. Attempts to solve the problem of uneven dispersion include phased arrays utilizing multiple transducers and diffusing reflectors. Phased arrays maintain coherency in one direction in return for loss of phase coherency in other directions. Diffusing reflectors lose all phase coherency as a function of dispersing sound waves broadly.

Another problem is that the mounting plate or baffle for such transducers may cause reflections leading to destructive interference patterns and distortions of the transducer output. Attempts to solve the problem of interference effects between the transducer and its mounting surface have utilized horns coupled to the transducers as well as contoured mounting surfaces intended to couple the transducer to the air with fewer interference patterns. Horns achieve this goal at the expense of broad dispersion. Contoured mounting surfaces reduce interference effects but do not improve dispersion.

One attempted solution involves a transducer placed at the focal point of a parabola or paraboloid and directed toward the parabolic surface, causing reflected rays that are parallel. In like manner, if a transducer is placed at the focal point of an ellipse, the waves reflected off the inner surface of the ellipse will be directed toward the other focal point of the ellipse.

An example of an elliptic reflector is disclosed in U.S. Pat. No. 4,629,030 to Ferralli, dated Dec. 16, 1986. In Ferralli, two elliptical shapes are disclosed sharing a single focal point. The two elliptical shapes are in reality a surface of revolution which forms a generally toroidal shape. The reflector is then one half of the generally toroidal shape. The other focal points of the semi-elliptical shape are the preferred positioning of transducers. However, in Ferralli, it is necessary to use baffles to prevent unwanted interference from reflected waves from transducers on one side of the toroidal shape from being reflected from the second side of the toroid. Further, baffling such as shown in Ferralli results in a resonant cavity that introduces further distortions. Accordingly, Ferralli, while claiming an essentially invariant band with relation to frequency, must lose considerable output power by baffling the reflector in order to accomplish his goal and, in fact, loses fidelity because of wave interference.

It is an object of this invention to provide a geometrically-shaped surface based on a surface of revolution made by a single ellipse, which will overcome the deficiencies of earlier devices, providing a relatively constant response over the entire frequency range.

It is still another object of the invention to provide an acoustic reflector which does not require baffling to overcome wave interference for the outgoing signal.

It is still another object of the invention to provide a high efficiency acoustic reflecting surface where all reflected energy is directed toward the user wherever positioned relative to the reflector.

The invention encompasses an acoustic reflector formed by a surface of revolution resulting from rotating an ellipse through approximately 180° about a line L passing through one of the focal points of the ellipse. The line L intersects the major axis of the ellipse at an acute angle, with the line L intersecting the ellipse at a point P. The surface of revolution is bounded at one end by a plane T and perpendicular to the line L. The surface is bounded at its other end by a second plane S also perpendicular to the line L at a point R. The point R is on a ray coincident with line L extending from the one focal point on line L and passing through the point P. The point R is exterior of the ellipse. The surface is bounded at its sides by plane S which is perpendicular to the plane T.

BRIEF DESCRIPTION OF THE DRAWINGS

FIG. 5 is a schematic showing the relation of the reflecting surface and the generating ellipse.

FIG. 7 is an alternative embodiment showing changes to FIG. 5.

DETAILED DESCRIPTION OF THE PREFERRED EMBODIMENT

Figure 1:
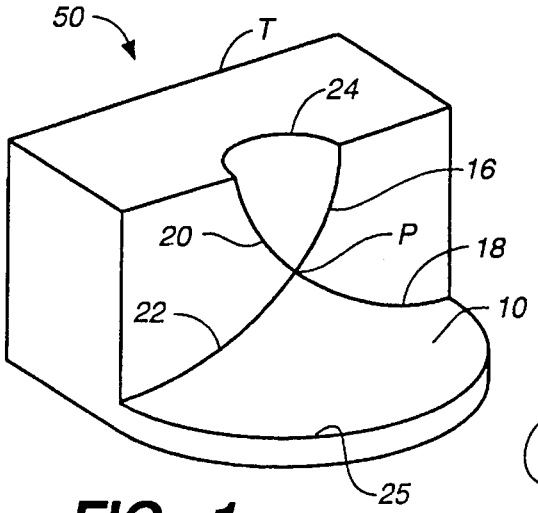
FIG. 1 is a perspective view of the reflective surface.

Referring to FIG. 1, a reflective surface 10 is shown. Reflective surface 10 is formed as best described in FIGS. 2A and 5. An ellipse 12 is located such that a line L passing through one of the focal points $F_1$ of the ellipse L intersects the major axis A of ellipse 12 at an angle $\alpha$. This line L intersects the perimeter of the ellipse 12 at a point P. A ray M extending from the focal point $F_1$ coincident with the line L extends through point P outwardly of the ellipse to at least a point R. Referring now to FIG. 5, the ellipse 12 is rotated about the line L approximately 180°. Such rotation forms the surface of revolution 10. The surface 10 is further defined by a plane T which is perpendicular to the line L and intersects line L at or near the focal point $F_1$. A second plane B, also perpendicular to line L and intersecting line L at point R, forms a lower boundary of the surface 10. The sides of the surface 10 are determined by a plane $S_1$ which is perpendicular to the plane T and extends outwardly from line L in one direction. This plane $S_1$ forms one side of the surface as defined by the intersecting arcs 16 and 18 in FIG. 5. A second plane, $S_2$, extends outwardly from line L in generally the opposite direction from plane $S_1$ and forms the second side of the surface as defined by the intersecting elliptical curves 20 and 22.

The surface may also be defined as follows: Referring to FIG. 1, the solid shape 50 has on one side the surface 10. The surface 10 above point P would be interior of an elliptical toroid formed by the rotation of ellipse 12, while the surface below point P would be the interior surface of the toroid formed by the rotation of ellipse 12.

The solid surface 50 would also have a top defined by plane T, a flat base B' and a rear surface 52. A pair of side panels $S_1$ and $S_2$ define the remainder of the front surface. A pair of side walls 54 and 56 connect side panels $S_1$ and $S_2$, respectively, to rear surface 52.

The intersection of plane T with the surface of revolution is defined by the circular curve 24, while the intersection of plane B and the surface of revolution is defined by the circular arc 25 in plane B. It is pointed out that curve 20 and its extension curve 18 form a segment of an ellipse, just as curve 16 and curve 22 form a segment of an ellipse. It is also pointed out that planes $S_1$ and $S_2$ may be a single plane, thereby indicating the ellipse which forms the surface of revolution has been rotated only 180°. In like manner, planes $S_1$ and $S_2$, which intersect at an angle β, may intersect at an angle somewhat less than 180° or somewhat more. It has been found that the angle β may vary from approximately 140° to 220° without degradation of the operation of the reflective surface.

Figure 2:
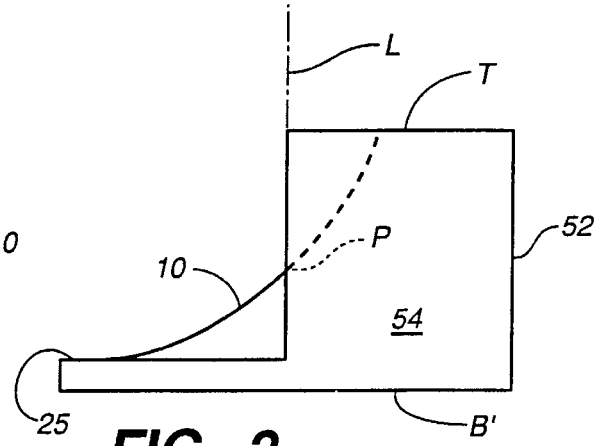
FIG. 2 is a side view of the reflective surface.
Figure 3:
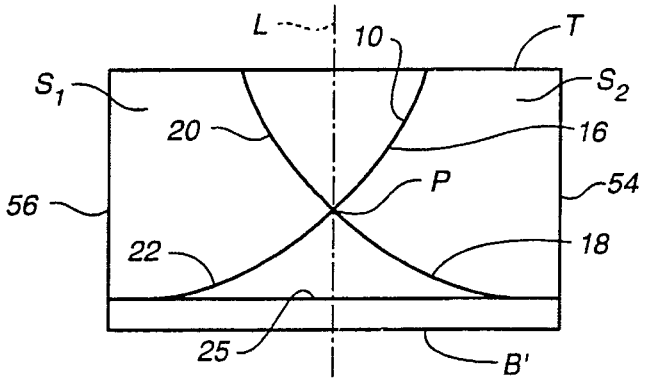
FIG. 3 is a front view of the reflective surface.
Figure 4:
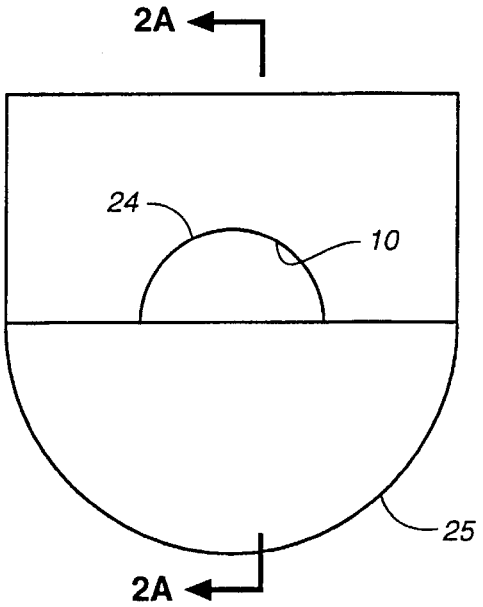
FIG. 4 is a top view of the reflective surface.
Figure 2A:
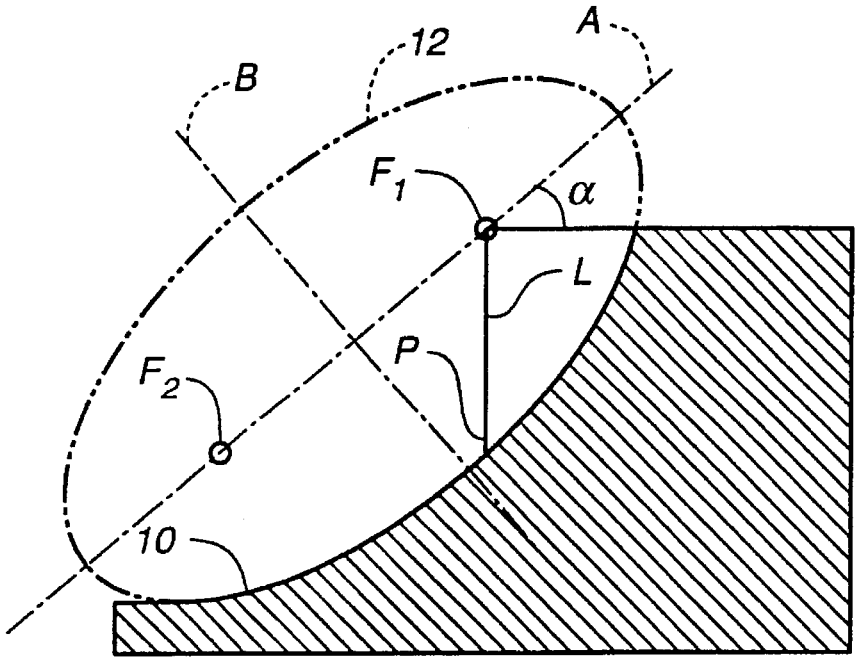
FIG. 2A is a sectional view of the reflective surface taken at section line 2A—2A of FIG. 4 and showing the generating ellipse.

Referring now to FIG. 2A, the ellipse 12 which is the basis of the surface of revolution is preferably oriented such that the major axis A is at a 40° angle to the line L, that is, angle α is equal to approximately 40°. This angle generally controls dispersion in the vertical plane such that the greater the angle α, the greater the dispersion of reflected sound. The ellipse is also formed such that the ratio of the major axis A to minor axis B, is 1.5:1. This ratio can vary from about 1.25:1 to about 3.00:1 without degradation of the characteristics of this reflector.

Figure 2B:
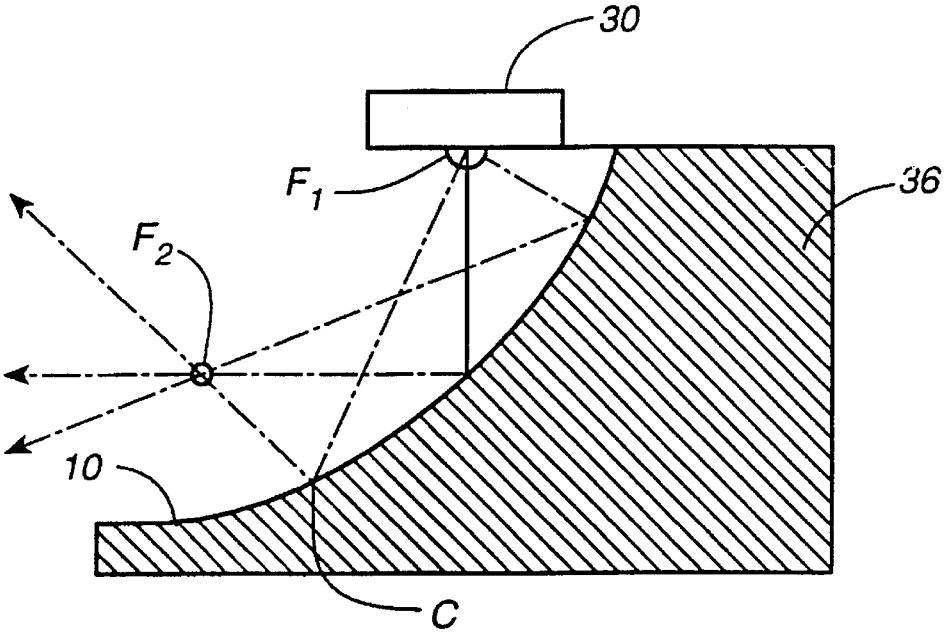
FIG. 2B is the same sectional view shown in FIG. 2A with a transducer positioned at one of the focal points of the generating ellipse.

Referring to FIG. 2B, a transducer 30, which may be in the form of any convenient device, is placed at focal point $F_1$ with its direction generally pointed at the ellipse. Varying the angle of the transducer relative to the surface of the ellipse varies the vertical response. Sound waves emanating from transducer 30 will then be reflected from the surface 10 back through the second focal points $F_2$ of the generating ellipse, as best shown in FIG. 2B. As can be seen, the sound waves reflected back through the second focal points $F_2$ converge at the arc of $F_2$s and then diverge generally uniformly outwardly from those points. The nature of the reflective surface 10, as shown in FIG. 2, is such that the reflected sound waves are widely dispersed through the angular orientation of the structure shown in FIG. 2B. (The structure shown in FIG. 2B has added dimension 36 such that the transducer 30 can be located as indicated.)

Alternatively, there may be a second generating ellipse 12' having the same focal point $F_1$, but having a different ratio of major to minor axes. It may or may not have the same second focal point $F_2$. The portion above the point P would therefore differ from the portion below the point P, as seen in FIG. 1. In still another condition shown in FIG. 7, the arcs 20 and 16 as seen in FIG. 1 could be defined by planes $S_1'$ or $S_2''$ other than $S_1$ and $S_2$, such that the concave portion above point P would have an angle β" greater than the angle β' below point P. These conditions are best shown in FIG. 7.

In employment, the acoustic reflector operates in accord with the principles set forth above. In particular, the transducer 30 is positioned at the focal point $F_1$ and activated so that the sound waves generated in the surrounding air are directed toward the reflective surface 10. By the nature of the ellipse, the distance from the focal point $F_1$ to any point C on the ellipse, plus the distance from that point C to a second focal point $F_2$, is constant and also equal to the length of the major axis of the ellipse. As a result, all sound emanating from the transducer 30 at one point in time reflected off the surface 10 and back through the second focal points $F_2$ arrives in phase at focal points $F_2$ having traveled the same distance. Sound waves traveling directly from the transducer to the listener in this invention have not interfered with the reflected sound as is the case in the prior art, but rather have been found to add substantially in phase with the reflected sound. The resulting response is well behaved and devoid of the comb filtering effects that are evident in prior art devices. Thus, there is no degradation or loss of power due to wave interference at the points $F_2$. As a consequence, the fidelity of reflected sound from this surface is far greater than previously designed surfaces.

Figure 6:
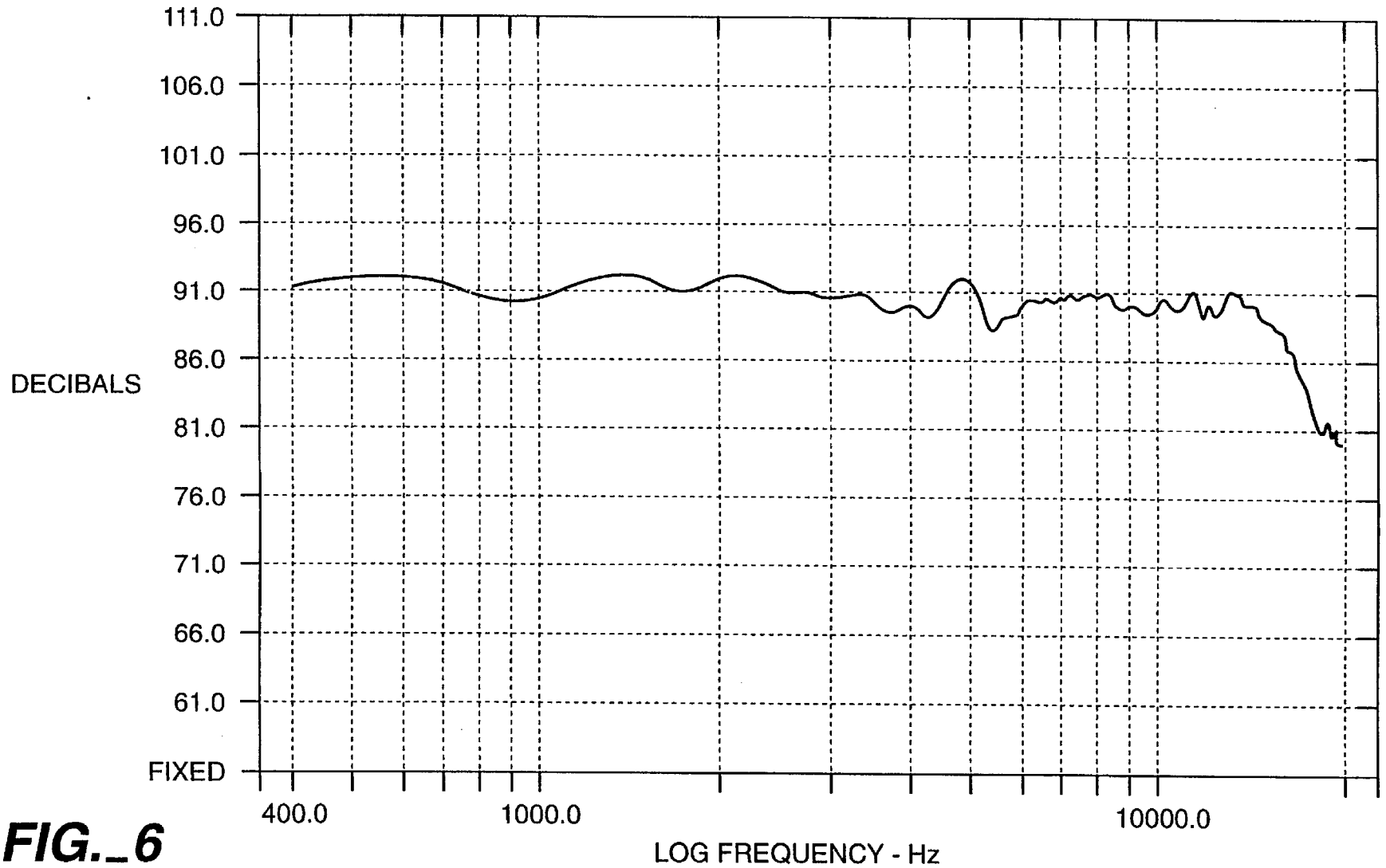
FIG. 6 is a graph showing the response of the reflective surface in decibels over a frequency range.

FIG. 6 is a graph of the response of two reflective surfaces as just described. The graph is a plot of the sound pressure level in decibels (y axis) for frequencies from under 400 Hz to 20,000 Hz. As can be seen, response is substantially uniform from under 400 Hz to about 16,000 Hz.

This invention, while described with a preferred embodiment, is limited only so far as the appended claims would limit the invention.

What is claimed is:

1. An acoustic reflector comprising a surface of revolution formed by rotating an ellipse through approximately 180° about a line L passing through one focal point $F_1$ of said ellipse, said line L intersecting the major axis A of said ellipse at an angle α, said line L intersecting said ellipse at a point P, said surface of rotation bounded at one end by a plane T intersecting line L in the vicinity of focal point $F_1$ and perpendicular to said line L, and said surface bounded at said other end by a plane B perpendicular to said line L at a point R, said point R on a ray coincident with line L extending from said one focal point $F_1$ passing through said point P, said point R exterior to said ellipse, said surface bounded at its sides by a pair of planes $S_1$ and $S_2$, planes $S_1$ and $S_2$ forming a line at their intersection coincident with line L, said planes $S_1$ and $S_2$ intersecting at an angle β.

2. The acoustic reflector of claim 1 wherein the angle α lies between 20° and 60°.

3. The acoustic reflector of claim 1 wherein said angle β lies between 140° and 220°.

4. The acoustic reflector of claim 1 wherein said angle α lies between 30° and 60°, and said angle β is between 140° and 220°.

5. The acoustic reflector of claim 1 wherein a wave producing transducer is positioned at $F_1$.

6. An acoustical reflector, comprising:

a solid member having a flat base, a top and a rear surface connecting the base to the top, and a reflective surface positioned distal of said rear surface and connected to said top, said reflective surface formed as a surface of revolution of an ellipse rotated about a line in the plane of said ellipse, said ellipse having a first and a second focal point, said line passing through said first focal point of the ellipse, said line perpendicular to said flat base and said line intersecting said ellipse at a point P, the major axis of said ellipse intersecting said line of rotation at an acute angle, said second focal point proximate said base and said first focal point distal of said base, said reflective surface being the exterior of said surface of revolution above the point P and exterior of said elliptical surface of revolution below the point P.

7. The transducer reflector of claim 6 further including first and second side panels generally parallel to said rear panel and each formed by the plane in the line of revolution and passing through point P.

8. The transducer reflector of claim 6 further including first and second flat side panels formed by planes passing through line P and wherein said line of revolution lies in said planes.

9. The transducer reflector of claim 6 further including side walls connecting said first and second panels to said rear wall.

10. The transducer reflector of claim 6 further including a transducer positioned at said one focal point.

11. The acoustical reflector of claim 6 wherein a wave-producing transducer is positioned at said first focal point.

12. The acoustical reflector of claim 6 where the angle of intersection of the said major axis of the ellipse and the line of rotation is between 20° and 60°.

13. The acoustical reflector of claim 8 wherein the first and second side panels intersect at the line of rotation at an angle between 160° and 210°.

14. The transducer reflector of claim 8 further including third and fourth flat side panels formed by planes passing through line P and wherein said line of revolution lies in said planes, said first and second side panels defining the reflective surface above the point P and said third and fourth side panels defining the reflective surface below the point P.

* * * * *

UNITED STATES PATENT AND TRADEMARK OFFICE

CERTIFICATE OF CORRECTION

PATENT NO. : 5,615,176

DATED : March 25, 1997

INVENTOR(S) : Emanuel LaCarrubba

It is certified that error appears in the above-indentified patent and that said Letters Patent is hereby corrected as shown below:

In the drawings, Sheet 2, FIG. 2A, the reference letter $\alpha$ should be applied to the acute angle formed by the longer ellipse axis denoted A and the line denoted L, rather than to the acute angle formed by axis A and the line perpendicular to line L.

Signed and Sealed this

Twenty-fourth Day of June, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,615,176

DATED : March 25, 1997

INVENTOR(S) : Emanuel LaCarrubba

It is certified that error appears in the above-indentified patent and that said Letters Patent is hereby corrected as shown below:

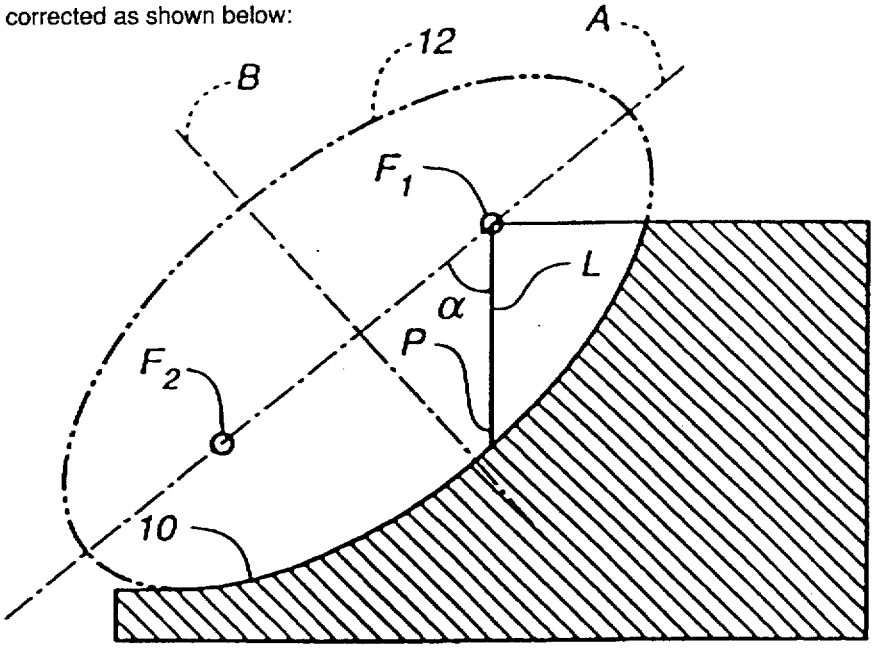

FIG._2A